US005730095A

United States Patent [19]

Dohn et al.

[11] Patent Number: 5,730,095

[45] Date of Patent: Mar. 24, 1998

[54] CAST CYLINDER HEAD OF A MULTI-CYLINDER INTERNAL COMBUSTION ENGINE

[75] Inventors: Michael Dohn, Sersheim; Eduard Zaiss, Stuttgart; Gerhard Eisberg, Nürtingen; Erwin Escherle, Stuttgart; Erhard Rau, Weilheim, all of Germany

[73] Assignee: Mercedes-Benz A.G., Stuttgart, Germany

[21] Appl. No.: 744,463

[22] Filed: Nov. 7, 1996

[30] Foreign Application Priority Data

Nov. 15, 1995 [DE] Germany ..... 195 42 495.6

[51] Int. Cl.[6] ..... F02F 1/36

[52] U.S. Cl. ..... 123/193.5

[58] Field of Search ..... 123/193.5, 193.3, 123/193.1

[56] References Cited

U.S. PATENT DOCUMENTS

| | | | |
|---|---|---|---|
| 4,951,622 | 8/1990 | Takahashi et al. | 123/193.5 |
| 5,038,732 | 8/1991 | Matayoshi et al. | 123/193.5 |
| 5,184,587 | 2/1993 | Ozeki | 123/193.5 |
| 5,207,210 | 5/1993 | Yamagata et al. | 123/193.5 |
| 5,220,853 | 6/1993 | Sado et al. | 123/193.5 |

FOREIGN PATENT DOCUMENTS

| | | |
|---|---|---|
| 0 416 600 | 3/1991 | European Pat. Off. . |
| 2 659 692 | 9/1991 | France . |
| 43 44 356 | 7/1994 | Germany . |
| 44 170 480 | 5/1995 | Germany . |

*Primary Examiner*—Marguerite McMahon
*Attorney, Agent, or Firm*—Klaus J. Bach

[57] ABSTRACT

In a cast cylinder head of a multi-cylinder internal combustion engine wherein the cylinder head has a cooling water space including gas flow passages and recesses for receiving spark plugs or fuel injection nozzles and blind bores extending into the cylinder head for receiving valve play adjustment elements and an oil supply passage extending longitudinally through the cylinder head and being in communication with the blind bores for supplying oil thereto, the blind bores are at least pre-cast and the oil supply passages are finish-cast during casting of the cylinder head.

6 Claims, 3 Drawing Sheets

CAST CYLINDER HEAD OF A MULTI-CYLINDER INTERNAL COMBUSTION ENGINE

BACKGROUND OF THE INVENTION

The invention relates to a cast cylinder head of a multi-cylinder internal combustion engine with a cooling water space and gas inlet and exhaust passages extending through the cooling water space of and with recesses fomed in the the cylinder head top for receiving spark plugs or fuel injection nozzles and blind bores for receiving valve play control elements.

DE 44 17 480 C1 discloses such a cylinder head with cylinder head top provided with blind bores for the reception of valve play adjustment elements. The blind bores are in communication with a longitudinal oil passage for supplying oil under pressure to the valve play adjustment elements and, by way of return flow openings, with an oil collection chamber. The blind bores and the longitudinal oil passage must be drilled in separate machining steps which, of course, is costly so that also the cylinder head is relatively expensive.

For general background information, reference is further made to EP 0,416,600 A1 and DE 43 44 356 A1.

It is the object of the present invention to provide a cylinder head of a relatively simple design such that its manufacturing costs are lower than those of cylinder heads presently available.

SUMMARY OF THE INVENTION

In a cast cylinder head of a multi-cylinder internal combustion engine wherein the cylinder head has a cooling water space including gas flow passages and recesses for receiving spark plugs or fuel injection nozzles and blind bores extending into the cylinder head for receiving valve play adjustment elements and an oil supply passage extending longitudinally through the cylinder head and being in communication with the blind bores for supplying oil thereto, the blind bores are at least pre-cast and the oil supply passages are finish-ast during casting of the cylinder head.

This is made possible by the use of a multi-function core (also called "oil gallery core") which comprises several partial core pieces. A base core is utilized for the forming of the return flow openings and the oil collection chamber. A first partial core piece connected to the base core is employed to form the blind bores. A second partial core piece which is connected to the first partial core piece is employed to form the longitudinal oil supply passage and the distribution passages. The multi-function core is supported in the bottom part of the mold by means of two core supports. In another embodiment, a secondary air channel extends in the longitudinal direction of the cylinder head and connecting passages branch off the secondary air channel and lead to the various exhaust gas flow passages. The secondary air channel and the connecting passages are formed by a third partial core piece which is connected to the other partial core pieces by means of a core support.

With the arrangement according to the invention, the manufacture of the cylinder head is simplified: The multi-function core facilitates the concurrent forming of a plurality of elements of the cylinder head so that machining procedures such as the drilling of the longitudinal oil passage and also the placement of various separate core pieces into the mold are eliminated. Preferably, the core piece forming the secondary air channel is separately supported on the core support remote from the timing chain cavity so that the secondary air channel is separated from the other partial core pieces whereby it has only a connection to the exhaust gas flow passages. However, the partial core piece may additionally be attached to the core support in the timing chain cavity so that the core is supported in a more stable manner. But, then it is necessary to close the secondary air channel after casting. The secondary air channel may extend through the cylinder head along any desirable path, but preferably, it extends meander-like between the gas flow channels and the recesses so that the cooling water space of the cylinder head remains undisturbed as much as possible.

Further features and advantages will become apparent from the following description of an embodiment of the invention shown in the accompanying drawings.

DESCRIPTION OF THE PREFERRED EMBODIMENT

Figure 1:
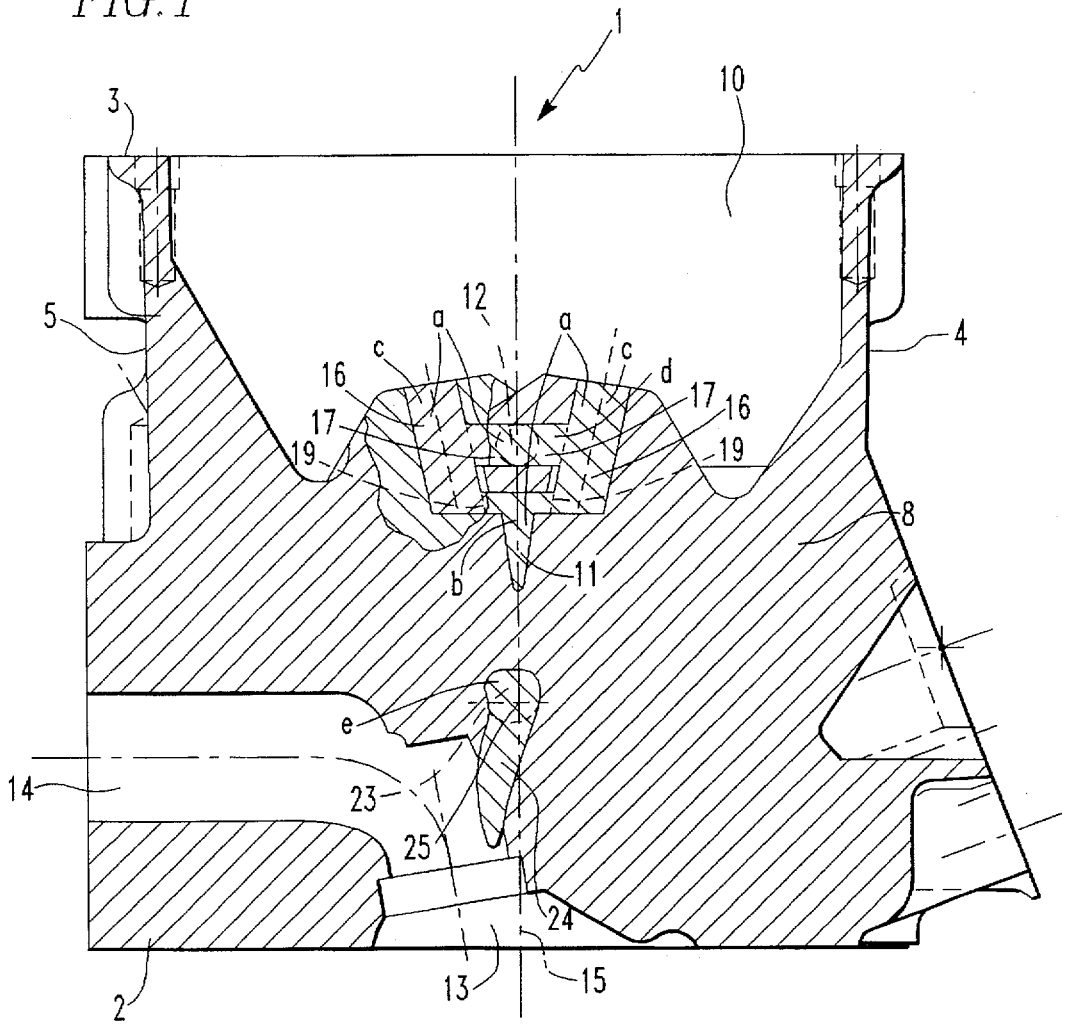
FIG. 1 is a cross-sectional view of the cylinder head according to the invention.
Figure 2:
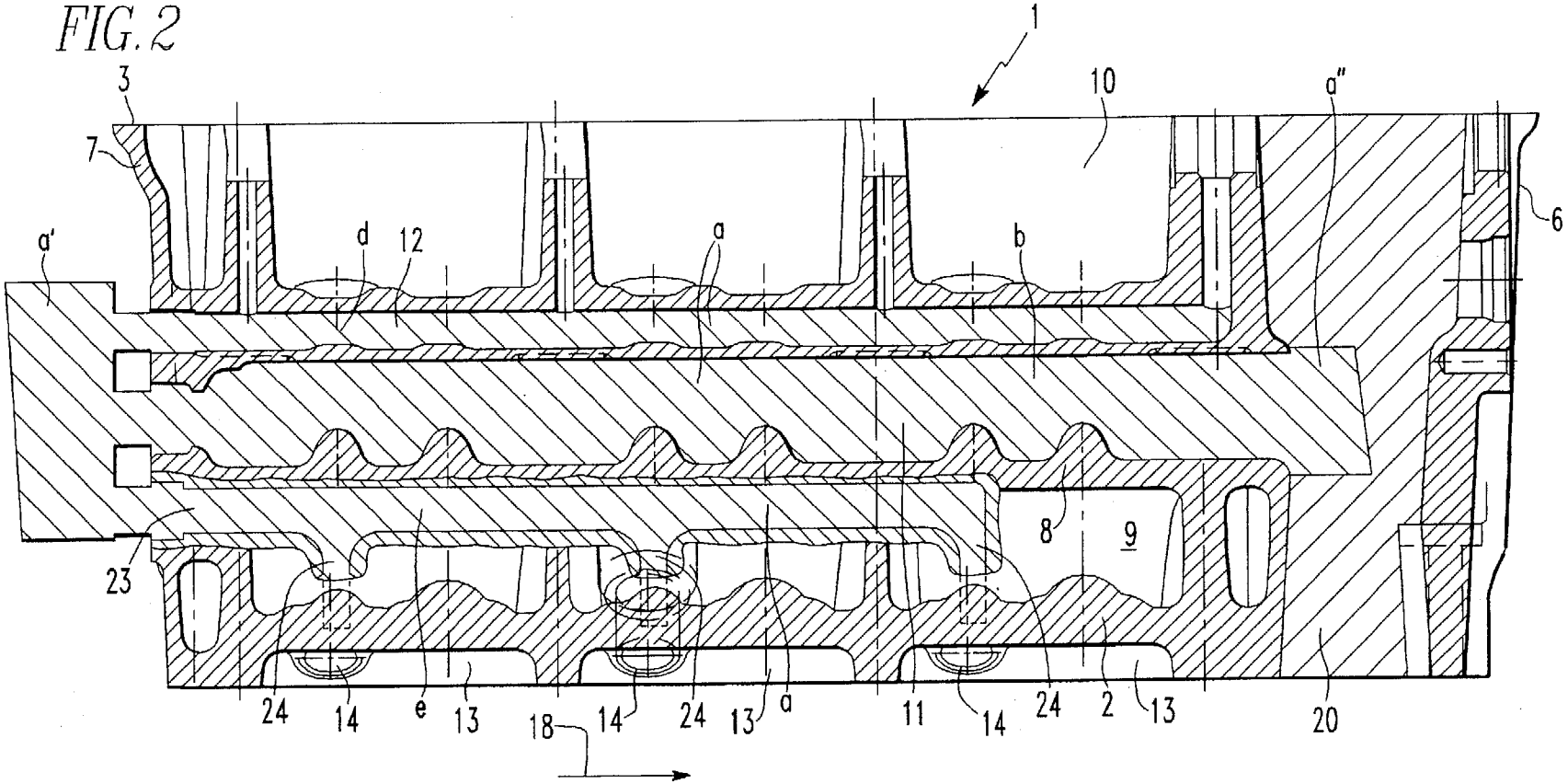
FIG. 2 is a longitudinal cross-sectional view of the cylinder head shown in FIG. 1.
Figure 3:
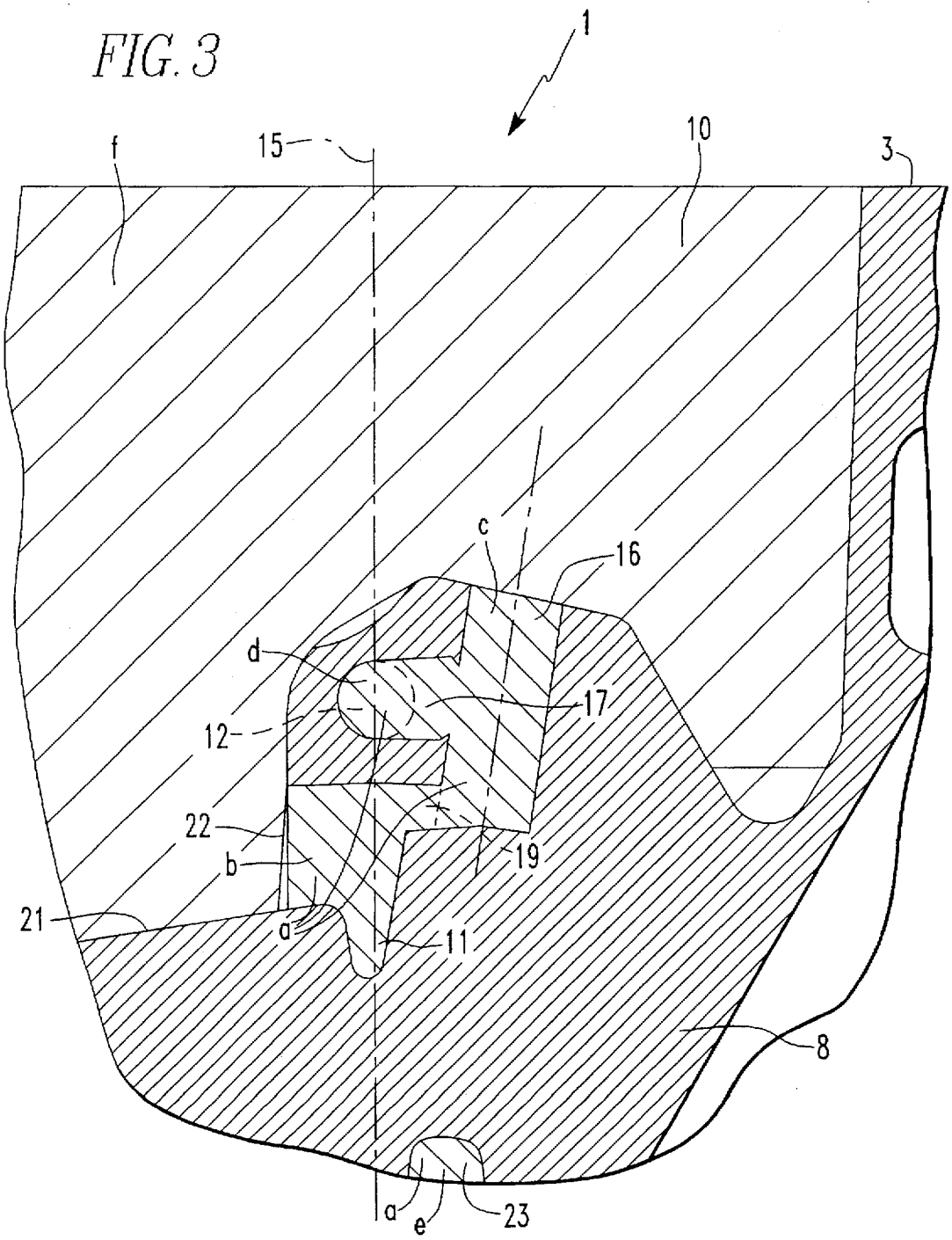
FIG. 3 is a partial sectional view of the cylinder head.

FIGS. 1 to 3 show a cylinder head 1 for a multi-cylinder internal combustion engine which is not shown as such. The cylinder head includes a one-piece casting with a cylinder head bottom 2 and longitudinal outer side walls 4, 5 and outer end walls 6, 7 extending upwardly to a cover mounting plane 3.

Cast into the cylinder head at a distance from the cylinder head bottom 2 is a cylinder head top wall 8 which separates a cooling water space 9 from a valve control chamber 10 disposed above the cooling water space 9. The cylinder head top wall 8 includes an oil collecting chamber 11 on top of which an oil supply passage 12 is disposed.

The cylinder head bottom 2 includes for each cylinder of the engine a combustion chamber 13 from which a gas intake and an exhaust passage 14 extend through the cylinder head. The cylinder head also includes recesses for the reception of a spark plug and a fuel injection nozzle but these recesses which also extend into the combustion chamber are not shown in the drawings. The gas intake passage and the gas exhaust passage 14 penetrate the water space 9 up to the longitudinal outer side walls 4, 5 of the cylinder head. The cylinder head top wall 8 includes blind bores 16 for the reception of valve play adjustment elements, the blind bores being arranged in the shape of a V, symmetrically to the longitudinal center plane 15 of the cylinder head. Each of the blind bores 16 is in communication with the pressurized oil passage supply passage 12 extending in a longitudinal direction 18 by way of a transverse distribution passage 17 whereby oil under pressure can be supplied to the valve play adjustment elements. In order to facilitate draining of the oil from the blind bores 16, they are in communication, by way of oil return openings 19, with the oil collection chamber 11 through which the oil can flow out of the cylinder head 1 and return to the oil pan of the engine by way of the timing chain cavity and oil return flow bores which are not shown in the drawings.

In accordance with the invention, the blind bores 16 the longitudinal oil supply passage 12, the distribution passages 17, the oil return openings 19 and the oil collection chamber 11 are formed by a single casting core which consists of a multi-functional core for casting all these passages and openings. Consequently, the need for drilling the longitudinal oil supply passage 12, the distribution passages 17 and the oil return openings and also the need for placing separate core pieces into a mold are eliminated. Even the blind bores 16 for the reception of the valve play adjustment elements are preformed during the casting and only need to be finish-drilled. The multi-functional core a, which is also called an oil gallery core, comprises several partial core pieces b to d. A first partial core piece c which is connected to the base core b serves to form the tubular oil supply passage 12 and the distribution passages 17 which also stabilize the core for the oil supply passage 12. The multi-functional core a is supported in the bottom mold by two core supports a', a". In the area of a spring support surface 21 of a valve operating mechanism, a well-defined separating plane 22 is disposed separating the core b from a core f forming the control chamber 10 whereby a casting skin is formed in the separating plane 22 which, during the subsequent machining of the spring support surface 21, is cut by the machining tool at least partially. This provides automatically for an oil return opening for the return flow of the oil.

In the cooling water space 9, there is further provided a secondary air channel 23 which extends meander-like in the longitudinal direction 18 between the gas flow passages 14 and the recesses for the spark plugs or the fuel injection nozzles such that the cooling water space 9 of the cylinder head 1 remains as undisturbed as possible. The secondary air channel 23 has connecting portions which branch off to the various exhaust passages 14 and open into the exhaust passages 14 at the sides of the exhaust passages 14 adjacent the inlet passages and the area 25 adjacent the exhaust valve opening.

The secondary air channel 23 and the connecting portions 24 are formed by another core piece e which is connected to the other core pieces b to d of the multi-function core a by means of the core support a'. With this arrangement, several machining and working steps are eliminated such as the deep drilling of the secondary air channel, the drilling of the connecting passages and the mounting of independent core pieces.

The core piece e extends in the area 25 adjacent the exhaust valve opening into an exhaust passage core which is not shown but which has a corresponding cavity. The casting metal skin formed during casting between the exhaust passage core and the core defining the connecting portion 24 is therefore disposed within the exhaust passage 14. This exhaust passage area 25 is normally machined to size by a milling cutter whereby the casting skin is also removed.

What is claimed is:

1. A cast cylinder head for a multi-cylinder internal combustion engine, said cylinder head having a cylinder head bottom and a cylinder head top, a cooling water space disposed between said cylinder head bottom and said cylinder head top and including gas flow passages and recesses extending through said cooling water space for receiving spark plugs or fuel injection nozzles and blind bores extending into said cylinder head top for receiving valve play adjustment elements, and an oil supply passage extending longitudinally through said cylinder head and being in communication with said blind bores for supplying oil under pressure to said valve play adjustment elements, said blind bores having at their inner ends oil return openings providing for communication with an oil collecting space formed during casting of the cylinder head, said blind bores being at least precast and said oil supply passage being finish-cast during casting of the cylinder head.

2. A cast cylinder head according to claim 1, wherein said blind bores and said oil supply passage are formed by interconnected core pieces such that said blind bores and said oil supply passage are in open communication when the cylinder head is cast.

3. A cast cylinder head according to claim 1, wherein said blind bores, said oil supply passage, various transverse oil distribution passages extending between said oil supply passage and said blind bores, said return openings and said oil collecting space are formed by a single casting core.

4. A cast cylinder head according to claim 3, wherein said casting core further includes a core piece forming a secondary air supply channel.

5. A cast cylinder head according to claim 1, wherein said core piece is supported on a core support disposed at one end of said cylinder head.

6. A cast cylinder head according to claim 4, wherein said core piece forming said secondary air supply channel is meander-shaped and extends between the gas flow passages and the recesses for receiving the spark plugs or fuel injection nozzles, said core piece having connecting portions extending from the core piece forming said secondary air supply channel to the exhaust passages.

* * * * *